US010359719B2

(12) United States Patent
Yamaura et al.

(10) Patent No.: US 10,359,719 B2
(45) Date of Patent: Jul. 23, 2019

(54) IMAGE FORMING APPARATUS HAVING TRANSFER BELT MOVING UNIT

(71) Applicant: FUJI XEROX CO., LTD., Tokyo (JP)

(72) Inventors: Masaaki Yamaura, Kanagawa (JP); Satoshi Shigezaki, Kanagawa (JP); Yutaka Kanai, Kanagawa (JP); Masayo Higashimura, Kanagawa (JP); Toshiaki Baba, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/915,867

(22) Filed: Mar. 8, 2018

(65) Prior Publication Data

US 2018/0292770 A1 Oct. 11, 2018

(30) Foreign Application Priority Data

Apr. 5, 2017 (JP) ..... 2017-075179

(51) Int. Cl.

| | |
|---|---|
| ***G03G 15/20*** | (2006.01) |
| ***G03G 15/16*** | (2006.01) |
| ***G03G 15/00*** | (2006.01) |
| *G03G 15/01* | (2006.01) |

(52) U.S. Cl.
CPC ..... *G03G 15/1615* (2013.01); *G03G 15/1685* (2013.01); *G03G 15/6517* (2013.01); *G03G 15/0105* (2013.01)

(58) Field of Classification Search
USPC ..... 399/107, 110, 121, 297, 302, 303, 308, 399/381, 384
See application file for complete search history.

(56) References Cited

U.S. PATENT DOCUMENTS

| | | | | |
|---|---|---|---|---|
| 7,610,009 | B2 | 10/2009 | Shimatsu | |
| 7,965,959 | B2 * | 6/2011 | Ishikawa | G03G 15/1615 399/121 |
| 9,335,668 | B2 * | 5/2016 | Mimbu | G03G 15/161 |

FOREIGN PATENT DOCUMENTS

| | | |
|---|---|---|
| JP | 2006-076771 A | 3/2006 |
| JP | 2007-148028 A | 6/2007 |
| JP | 2007-218949 A | 8/2007 |

* cited by examiner

*Primary Examiner* — Hoan H Tran
(74) *Attorney, Agent, or Firm* — Sughrue Mion, PLLC

(57) ABSTRACT

An image forming apparatus includes: a transfer member that transfers a toner image to a continuous sheet, the transfer member having a lower hardness than a member opposed thereto with the continuous sheet therebetween when the continuous sheet is transported; and a moving unit that moves the transfer member in a direction intersecting the direction in which the continuous sheet is transported.

19 Claims, 13 Drawing Sheets

FIG. 10A

| THICKNESS OF SHEET ($\mu$m) | DISTANCE TRAVELLED BEFORE CRACKING OCCURS (m) |
|---|---|
| 100 | 330000 |
| 150 | 230000 |
| 200 | 170000 |

FIG. 10B

| THICKNESS OF SHEET ($\mu$m) | MOVEMENT TIMING (m) | NUMBER OF MOVEMENTS | CRACK |
|---|---|---|---|
| 100 | 330000 | 2 | NOT OCCURRED |
| 150 | 230000 | 3 | NOT OCCURRED |
| 200 | 170000 | 4 | NOT OCCURRED |

IMAGE FORMING APPARATUS HAVING TRANSFER BELT MOVING UNIT

CROSS-REFERENCE TO RELATED APPLICATIONS

This application is based on and claims priority under 35 USC 119 from Japanese Patent Application No. 2017-075179 filed Apr. 5, 2017.

BACKGROUND

Technical Field

The present invention relates to an image forming apparatus.

SUMMARY

According to an aspect of the invention, there is provided an image forming apparatus including: a transfer member that transfers a toner image to a continuous sheet, the transfer member having a lower hardness than a member opposed thereto with the continuous sheet therebetween when the continuous sheet is transported; and a moving unit that moves the transfer member in a direction intersecting the direction in which the continuous sheet is transported.

BRIEF DESCRIPTION OF THE DRAWINGS

Exemplary embodiments of the present invention will be described in detail based on the following figures, wherein:

FIG. 10A is a table showing the distances L travelled by continuous sheets P before resin coat layers of a second transfer belt crack in a comparison example, and FIG. 10B is a table showing the relationship between the traveling distance and cracking in the resin coat layers of the second transfer belt in an example.

DETAILED DESCRIPTION

The present invention will be described in more detail below by way of exemplary embodiments and examples with reference to the drawings. Note that the present invention is not limited to these exemplary embodiments and examples.

Note that the drawings are schematic, and the dimensional ratios etc., are different from those in actuality. For the ease of understanding, illustration of parts that are unnecessary for the descriptions will be omitted as appropriate.

Figure 1:
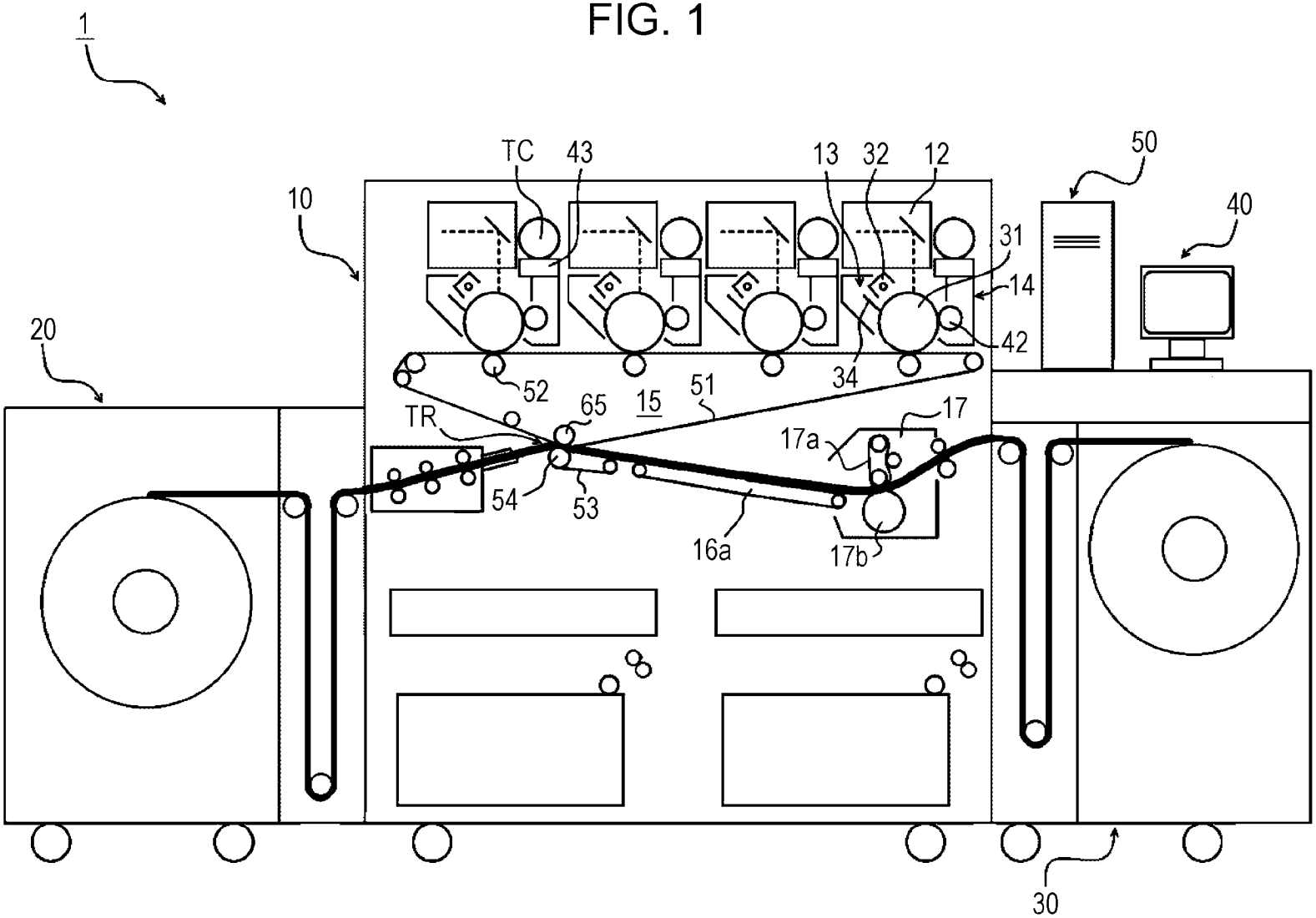
FIG. 1 is a schematic cross section showing, in outline, the configuration of an image forming apparatus according to a first exemplary embodiment.
Figure 2:
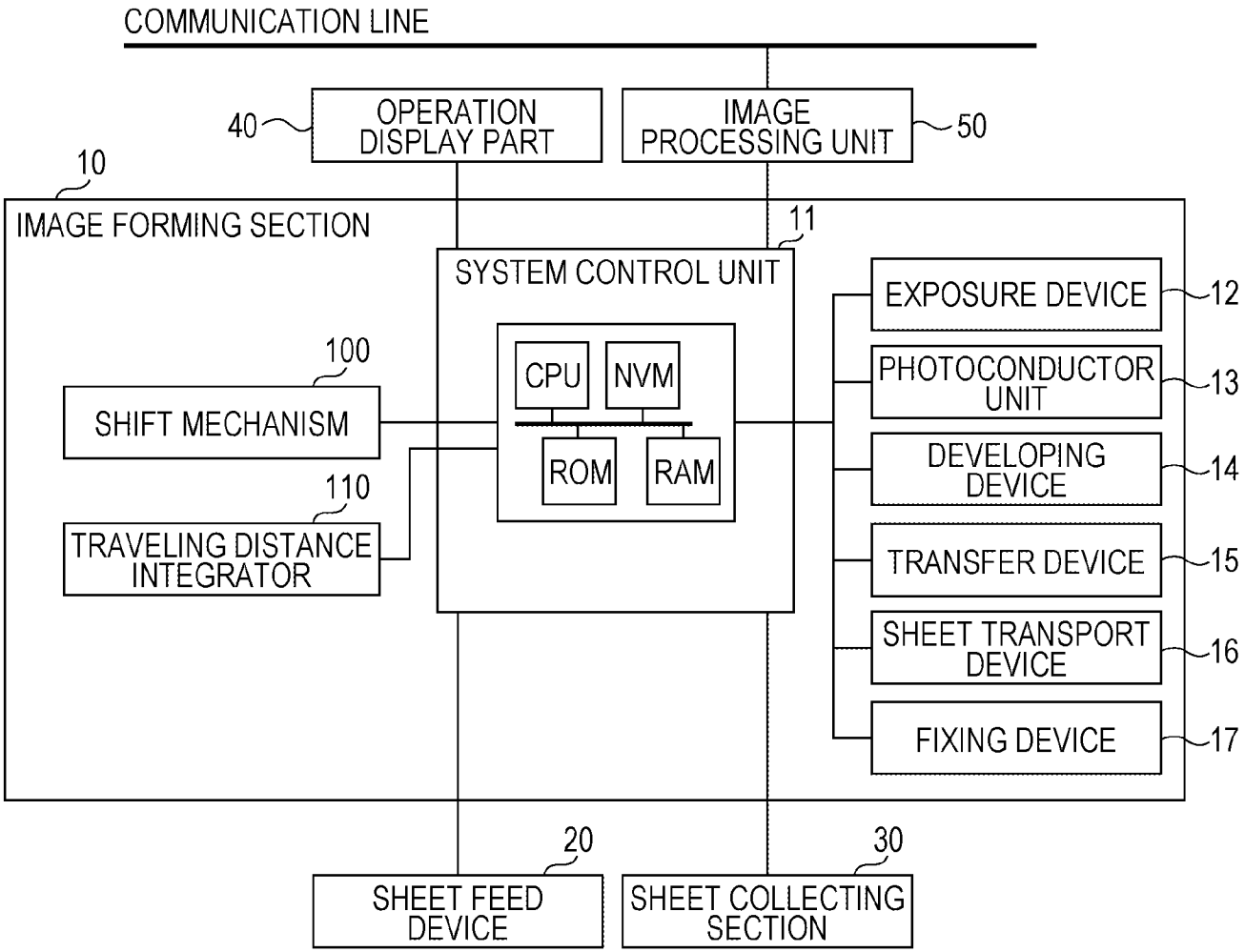
FIG. 2 is a functional block diagram of the image forming apparatus according to the first exemplary embodiment.

First Exemplary Embodiment (1) Overall Configuration and Operation of Image Forming Apparatus (1.1) Overall Configuration of Image Forming Apparatus FIG. 1 is a schematic cross section showing, in outline, the configuration of an image forming apparatus 1 according to this exemplary embodiment, and FIG. 2 is a functional block diagram of the image forming apparatus 1.

The image forming apparatus 1 includes: an image forming section 10; a sheet feed device 20 attached to one end of the image forming section 10; a sheet collecting section 30 for collecting a printed sheet, provided at the other end of the image forming section 10; an operation display part 40; and an image processing unit 50 for generating image information from printing information transmitted from a higher-level machine.

The image forming section 10 includes a system control unit 11, exposure devices 12, photoconductor units 13, developing devices 14, a transfer device 15, sheet transport devices 16*a*, 16*b*, and 16*c*, and a fixing device 17. The image forming section 10 forms, on the basis of the image information received from the image processing unit 50, a toner image on a continuous sheet P fed from the sheet feed device 20.

The sheet feed device 20 includes a sheet feed member 20*a*, on which the continuous sheet P is rolled. The sheet feed member 20*a* is rotatably supported and feeds the continuous sheet P to the image forming section 10 while applying tension thereto.

The sheet collecting section 30 collects the continuous sheet P having an image output thereto in the image forming section 10 with a take-up roller 30*a*, which is drivingly rotated.

The operation display part 40 is used for input of various settings and instructions and for display of information. In other words, the operation display part 40 serves as a user interface. The operation display part 40 is formed of a combination of a liquid-crystal display panel, operation buttons, a touch screen, etc.

(1.2) Configuration and Operation of Image Forming Section

In the thus-configured image forming apparatus 1, the continuous sheet P extending from the sheet feed member 20*a* of the sheet feed device 20 is transported to the image forming section 10 in accordance with timing of image formation.

The photoconductor units 13 are provided parallel to one another below the exposure devices 12 and include drivingly rotating photoconductor drums 31, serving as image carriers. A charger 32, the exposure device 12, the developing device 14, a first transfer roller 52, and a cleaning blade 34 are provided around each photoconductor drum 31 in the rotation direction thereof.

The developing devices 14 include developing rollers 42 that are opposed to the photoconductor drums 31. The developing devices 14 have substantially the same configuration except for developer G and form, with the developing rollers 42 thereof, yellow (Y), magenta (M), cyan (C), and black (K) toner images on the photoconductor drums 31.

Replaceable toner cartridges TC storing developer G, and developer supply devices 43 for supplying the developer G from the toner cartridges TC to the developing devices 14 are disposed above the developing devices 14.

The surfaces of the rotating photoconductor drums 31 are charged by the chargers 32, and electrostatic latent images are formed thereon with latent-image forming light emitted from the exposure devices 12. The electrostatic latent images formed on the photoconductor drums 31 are developed into toner images by the developing rollers 42.

The transfer device 15 includes an intermediate transfer belt 51, which is an example of an image carrier, to which the color toner images formed on the photoconductor drums 31 of the photoconductor units 13 are transferred in a superimposed manner, the first transfer rollers 52 that sequentially transfer the color toner images formed by the photoconductor units 13 to the intermediate transfer belt 51 (first transfer), and a second transfer belt 53, which is an example of a transfer member, that transfers the superimposed color toner image on the intermediate transfer belt 51 to a sheet, serving as a recording medium (second transfer).

The second transfer belt 53 is stretched between a second transfer roller 54 and a separating roller 55, which are an example of multiple rotary members. The second transfer belt 53 is nipped between the second transfer roller 54 and a backup roller 65, which is disposed on the inner-surface side of the intermediate transfer belt 51 and is an example of an opposing member, thus forming a second transfer part TR.

The color toner images formed on the photoconductor drums 31 of the photoconductor units 13 are sequentially and electrostatically transferred to the intermediate transfer belt 51 by the first transfer rollers 52, to which predetermined transfer voltages are supplied from a power supply device or the like (not shown) controlled by the system control unit 11, thus forming a superimposed toner image in which the color toner images are superimposed.

As the intermediate transfer belt 51 moves, the superimposed toner image on the intermediate transfer belt 51 is transported to the area where the second transfer belt 53 is located (i.e., the second transfer part TR). In accordance with the transportation of the superimposed toner image to the second transfer part TR, a continuous sheet P is fed from the sheet feed device 20 to the second transfer part TR. A transfer voltage is applied to the backup roller 65, which opposes the second transfer roller 54 with the second transfer belt 53 therebetween, thus transferring the superimposed toner image on the intermediate transfer belt 51 to the continuous sheet P.

The residual toner on the surfaces of the photoconductor drums 31 is cleaned by the cleaning blades 34 and is collected in waste-toner storage units (not shown). The surfaces of the photoconductor drums 31 are recharged by the chargers 32.

The fixing device 17 includes an endless fixing belt 17*a* that rotates in one direction and a pressure roller 17*b* that is in contact with the circumferential surface of the fixing belt 17*a* and rotates in one direction. The fixing belt 17*a* and the pressure roller 17*b* are pressed against each other at one portion, forming a nip portion (fixing area).

The continuous sheet P having the toner image transferred thereto in the transfer device 15 but not yet fixed is transported, via the sheet transport device 16*a*, to the fixing device 17. The continuous sheet P transported to the fixing device 17 is subjected to heat and pressure by the fixing belt 17*a* and the pressure roller 17*b*, and thus, the toner image is fixed.

The continuous sheet P having the image fixed thereto is fed to the sheet collecting section 30 via the sheet transport device 16*b*. The continuous sheet P fed to the sheet collecting section 30 is wound on the take-up roller 30*a* while being tensioned.

Figure 3:
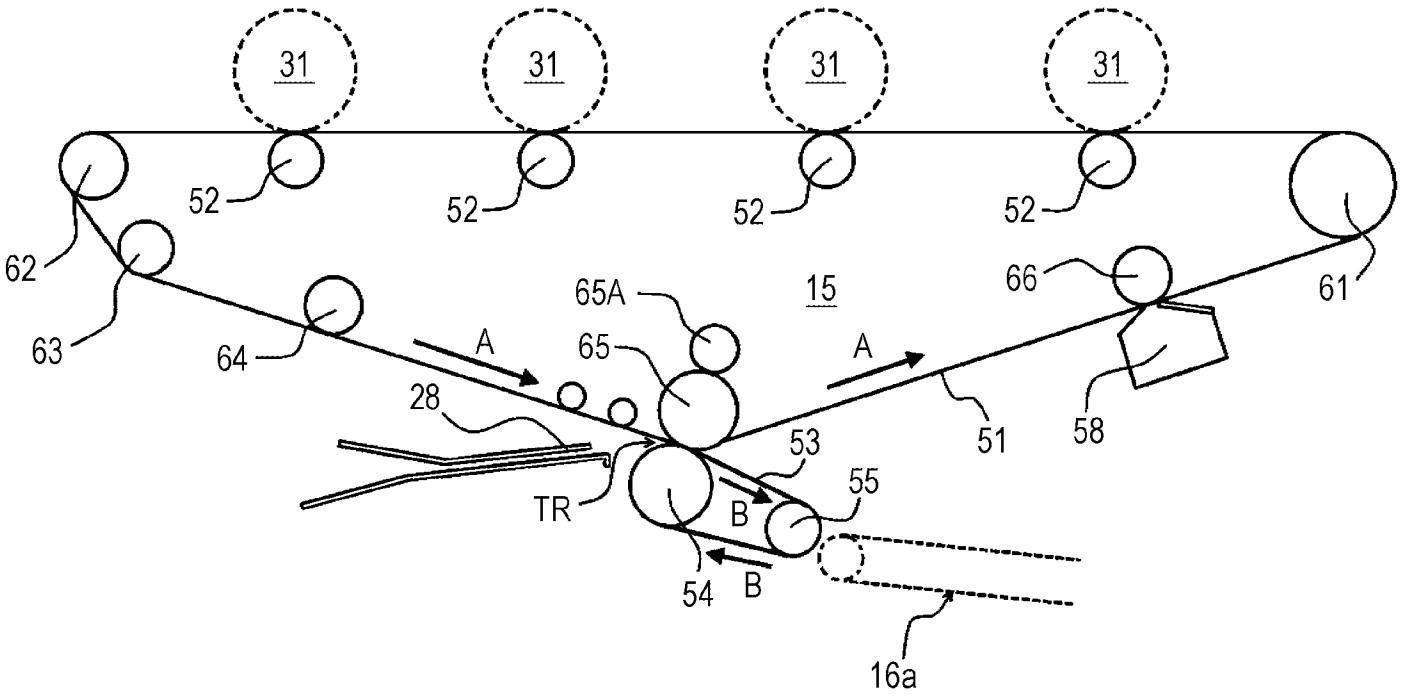
FIG. 3 is a schematic cross section showing the configuration of a transfer device according to the first exemplary embodiment.
Figure 4A:
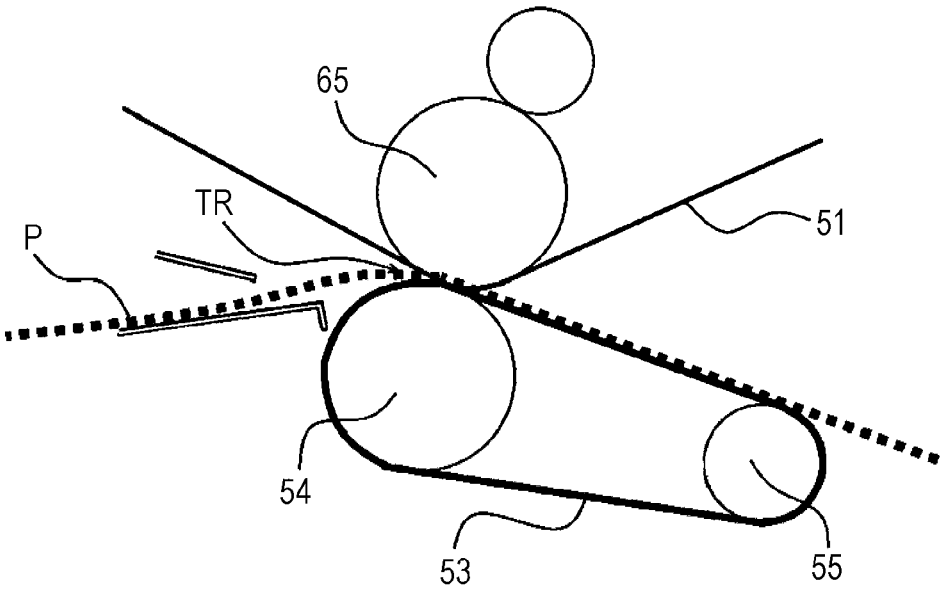
FIGS. 4A and 4B are a schematic cross section and a schematic plan view, respectively, showing the configuration of a second transfer part.
Figure 4B:
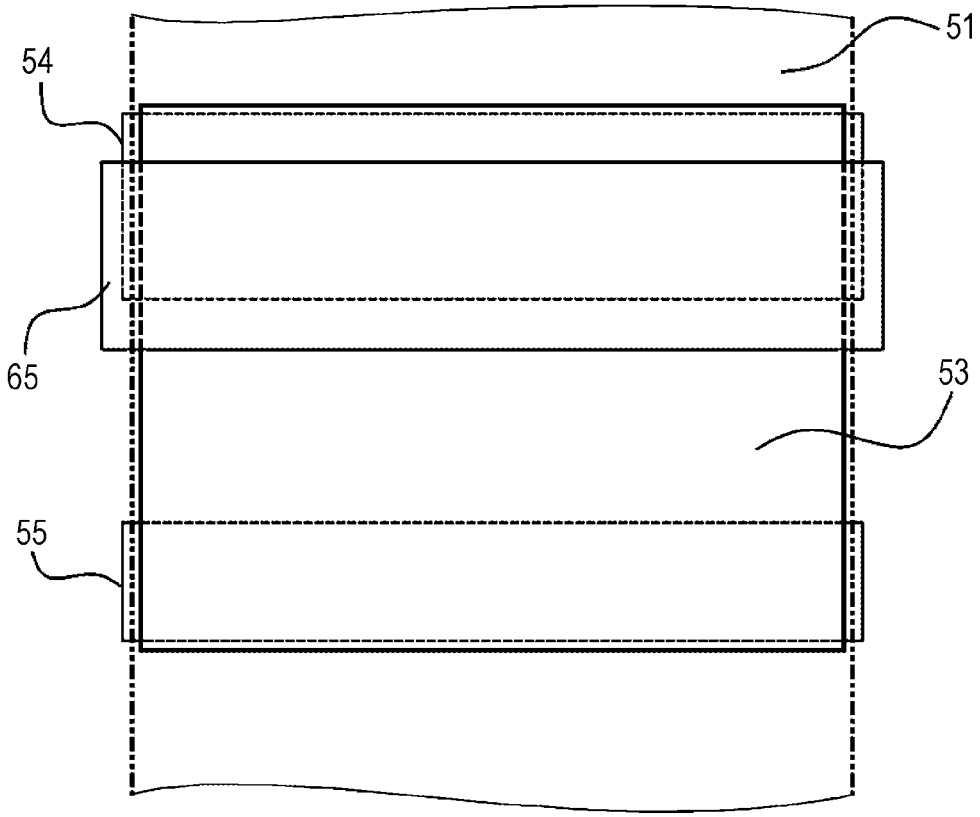

(2) Configuration and Effect of Transfer Device (2.1) Configuration of Transfer Device FIG. 3 is a schematic cross section showing the configuration of the transfer device 15 of the image forming apparatus 1 according to this exemplary embodiment, and FIGS. 4A and 4B are a schematic cross section and a schematic plan view, respectively, showing the configuration of the second transfer part TR of the image forming apparatus 1.

The transfer device 15 includes the intermediate transfer belt 51, the first transfer rollers 52, the second transfer belt 53, the backup roller 65, the second transfer roller 54, and a cleaning device 56.

The intermediate transfer belt 51 (shown by a two-dot chain line in FIG. 4B) is formed of a resin, such as polyimide (PI) or polyamide-imide (PAI), containing an adequate amount of conducting agent, such as carbon black. The intermediate transfer belt 51 is formed to have a volume resistivity of $10^{10}$ to $10^{14}$ Ω·cm. The intermediate transfer belt 51 is a film-like endless belt having a thickness of, for example, about 0.1 mm.

The intermediate transfer belt 51 is stretched and revolves (see arrows A in FIG. 3) around: a driving roller 61, which circularly drives the intermediate transfer belt 51; a driven roller 62, which supports the intermediate transfer belt 51 extending substantially straight in the direction in which the photoconductor drums 31 are arranged; a tension roller 63 that applies tension to the intermediate transfer belt 51 and prevents the intermediate transfer belt 51 from meandering; a support roller 64 that is provided upstream of the second transfer part TR and supports the intermediate transfer belt 51; the backup roller 65 provided at the second transfer part TR; and a cleaning backup roller 66 that is provided at a cleaning part for scraping off residual toner on the intermediate transfer belt 51.

The backup roller 65 is formed of an EPDM/NBR blended rubber tube with carbon dispersed in the surface thereof, and the inside thereof is EPDM rubber. The backup roller 65 is formed to have a surface resistivity of $10^7$ to $10^{10}\Omega/\square$ and a diameter of 28 mm. The Asker C hardness of the backup roller 65 is set to, for example, 70 degrees.

The backup roller 65 is disposed on the inner-surface side of the intermediate transfer belt 51 and serves as an opposing electrode for the second transfer belt 53. A metal power-feed roller 65A for supplying a direct current voltage to form a second-transfer electric field at the second transfer part TR is disposed in contact with the backup roller 65.

The first transfer rollers 52 are provided so as to oppose the photoconductor drums 31 with the intermediate transfer belt 51 therebetween, and voltages having the polarity opposite to the polarity of the toner are supplied thereto. As a result, the toner images on the photoconductor drums 31 are sequentially and electrostatically attracted to the intermediate transfer belt 51, thus forming a superimposed toner image on the intermediate transfer belt 51.

The second transfer belt 53 is a semiconducting endless belt having a thickness of, for example, about 0.3 to 0.5 mm. The second transfer belt 53 is formed of rubber, such as chloroprene or EPDM, containing an adequate amount of conducting agent, such as carbon black. The second transfer belt 53 is formed to have a volume resistivity of, for example, $10^6$ to $10^{10}$ Ω·cm. The outer and inner surfaces of the second transfer belt 53 have resin coat layers 53*a*, which are formed of a urethane-modified fluorocarbon resin, to inhibit attachment of the toner or the like.

As shown in FIG. 3, the second transfer belt 53 is stretched between the second transfer roller 54 and the separating roller 55 with a predetermined tension. In this exemplary embodiment, the second transfer belt 53 receives a driving force from the second transfer roller 54 and rotates at a predetermined speed (see arrows B in FIG. 3).

The second transfer roller 54 is formed of a metal shaft, serving as a core, and a conducting layer formed on the outer circumference thereof. The conducting layer is formed of a foam, such as silicone rubber, urethane rubber, or EPDM, with a conducting agent, such as carbon black, dispersed therein. The second transfer roller 54 is disposed so as to oppose the backup roller 65 with the second transfer belt 53 and the intermediate transfer belt 51 therebetween.

The second transfer roller 54 is electrically grounded and constitutes, together with the backup roller 65, the second transfer part TR where the toner image held on the intermediate transfer belt 51 is second-transferred to the continuous sheet P transported to the second transfer belt 53.

The second transfer roller 54 is drivingly rotated by a driving motor (not shown) connected thereto and rotates the second transfer belt 53.

As shown in FIG. 3, the separating roller 55 is located downstream of the second transfer roller 54 in the direction in which the second transfer belt 53 rotates (arrow B direction). The separating roller 55 and the second transfer roller 54 form a belt surface that transports the continuous sheet P to the downstream side.

The diameter of the separating roller 55 is smaller than that of the second transfer roller 54 so as to separate the continuous sheet P from the surface of the second transfer belt 53.

(2.2) Movement Control of Second Transfer Belt

Figure 5A:
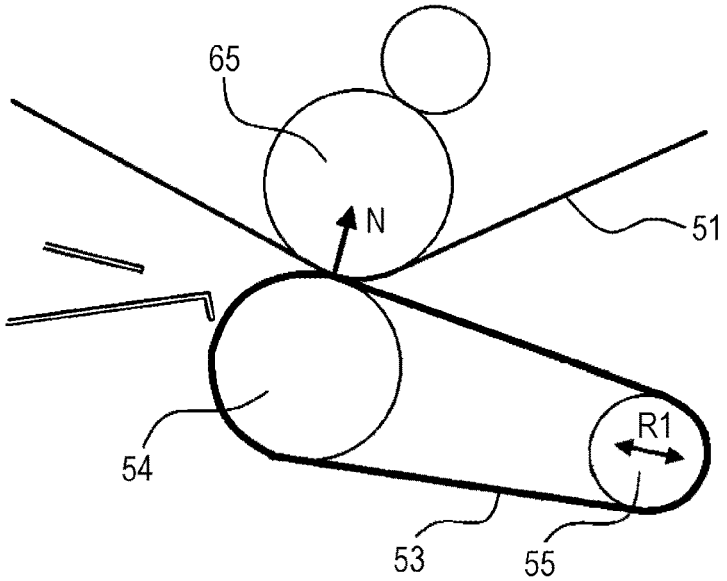
FIG. 5A is a schematic cross section of the second transfer part, showing that a rotation shaft of a separating roller is moved by a shift mechanism.
Figure 5B:
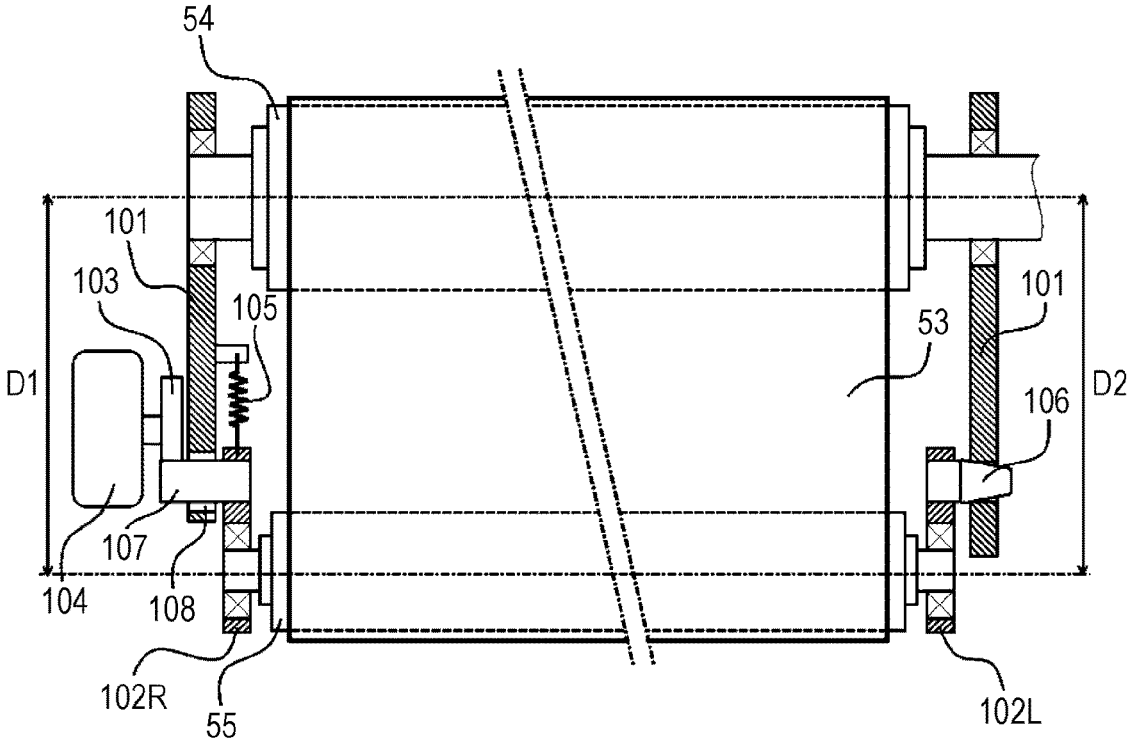
FIG. 5B is a schematic plan view showing a configuration example of the shift mechanism.
Figure 6:
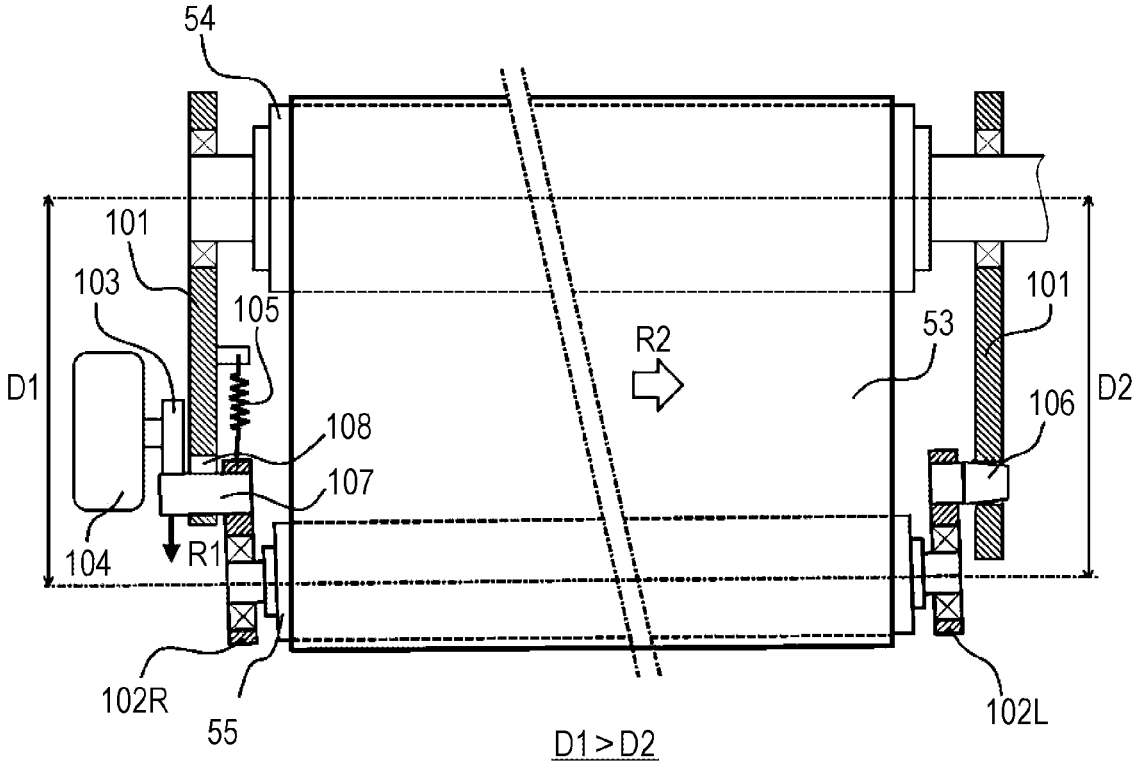
FIG. 6 is a schematic plan view showing that an operation of the shift mechanism moves the second transfer belt, moving the rotation shaft of the separating roller in a thrust direction.
Figure 7:
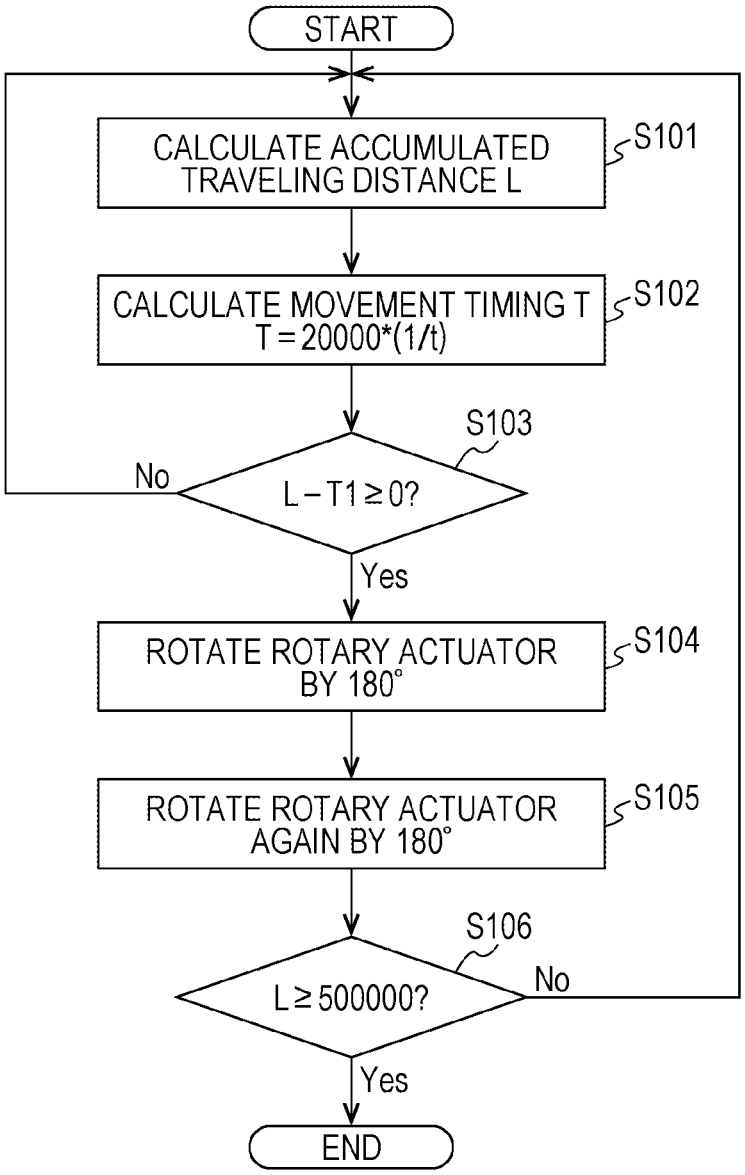
FIG. 7 is a flowchart showing a flow of the operation of the shift mechanism.
Figure 13A:
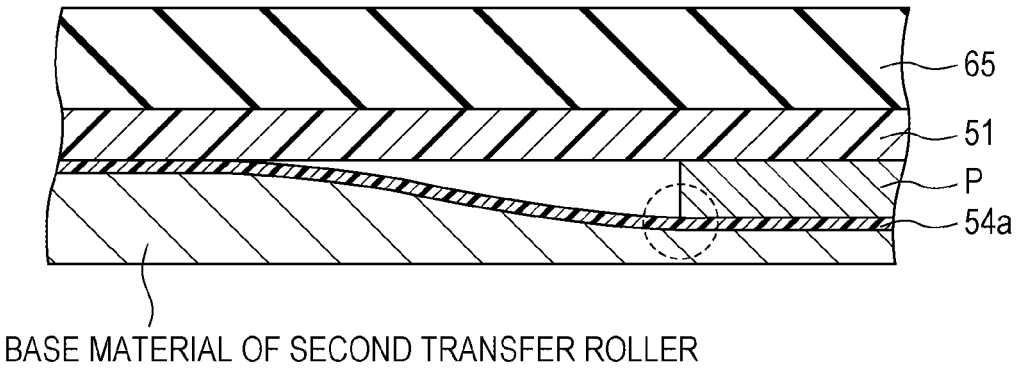
FIG. 13A is an enlarged cross section showing the relationship among the backup roller, the intermediate transfer belt, the sheet, and the second transfer belt at a sheet-end portion of the second transfer part.
Figure 13B:
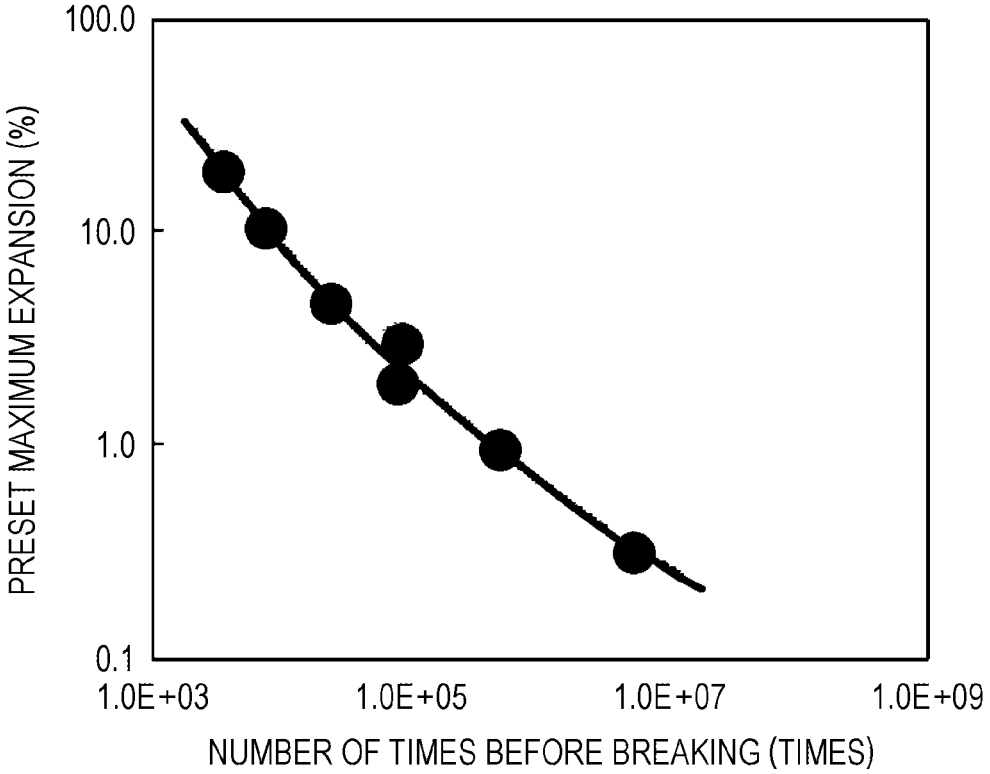
FIG. 13B shows the relationship between the number of times the resin coat layers of the second transfer belt are bent before they are broken and the amount of expansion and contraction.

FIG. 5A is a schematic cross section of the second transfer part TR, showing that the rotation shaft of the separating roller 55 is moved by a shift mechanism 100, and FIG. 5B is a schematic plan view showing a configuration example of the shift mechanism 100. FIG. 6 is a schematic plan view showing that an operation of the shift mechanism 100 moves the rotation shaft of the separating roller 55, moving the second transfer belt 53 in the thrust direction. FIG. 7 is a flowchart showing a flow of the operation of the shift mechanism 100. FIG. 13A is an enlarged cross section showing the relationship among the backup roller 65, the intermediate transfer belt 51, the continuous sheet P, and the second transfer belt 53 at a sheet-end portion of the second transfer part TR, and FIG. 13B shows the relationship between the number of times the resin coat layers 53*a* of the second transfer belt 53 are bent before they are broken and the amount of expansion and contraction.

Now, a phenomenon occurring in the second transfer belt 53 stretched between and revolves around the second transfer roller 54 and the separating roller 55 will be described.

In the second transfer part TR, the continuous sheet P is nipped at a transfer nip formed between the second transfer belt 53 and the backup roller 65 with the intermediate transfer belt 51 therebetween, and a second-transfer bias voltage is applied. As a result, an electric field is formed, with which the toner image is transferred to the continuous sheet P.

The intermediate transfer belt 51 is formed of a heat-curable resin, such as polyimide or polyamide-imide, and the second transfer belt 53 is formed of an elastic member including a rubber layer 53*b* and a resin coat layer provided thereon. When the continuous sheet P is pressed at the transfer nip of the second transfer part TR, the resin coat layers 53*a* of the second transfer belt 53, which are softer than the intermediate transfer belt 51, are deformed at portions corresponding to the ends of the continuous sheet P, generating a large strain (see the a dashed-line encircled area in FIG. 13A). Thus, the portions of the second transfer belt 53 corresponding to the ends of the sheet are repeatedly strained and unstrained as they pass through the transfer nip, which may lead to fatigue breakage and cracking.

As shown in FIG. 13B, it is known that the number of times the resin coat layers 53*a* can be expanded and contracted before they are broken decreases as the amount of expansion and contraction thereof increases. In other words, the likelihood of breakage increases with the number of times the resin coat layers 53*a* are expanded and contracted as the amount of expansion and contraction thereof per time increases. Because the amount of expansion and contraction depends on the thickness of the continuous sheet P, the distance travelled by a thick sheet before cracking occurs is smaller the distance travelled by a thin sheet before cracking occurs.

To suppress cracking at the portions corresponding to the ends of the continuous sheet P, the following countermeasure can be taken. That is, when a cut sheet is used, the sheet is transported by the second transfer belt 53 in the second transfer part TR, independently of the sheet feed device 20 and the sheet collecting section 30. Hence, by moving, as appropriate, the sheet transport position in a direction intersecting the direction in which the second transfer belt 53 transports the sheet, the damage to the surface of the second transfer belt 53 can be easily distributed.

Meanwhile, when a continuous sheet is used, the sheet is transported by the sheet feed device 20 and the sheet collecting section 30. Hence, it is impossible to independently shift the sheet transport position (sheet position) in the second transfer part TR. As a result, unless the sheet position in the sheet feed device 20 and the sheet collecting section 30 in the direction intersecting the sheet transport direction or the sheet width is changed, the sheet will always pass the same position of the second transfer belt 53 in the width direction, and the damage to the second transfer belt 53 cannot be distributed. As a result, the resin coat layers 53*a* may crack at an early stage, reducing the life of the second transfer belt 53.

The image forming apparatus 1 according to this exemplary embodiment includes the shift mechanism 100, serving as a moving unit, that moves the second transfer belt 53, serving as a transfer member, in a direction intersecting the direction in which a continuous sheet is transported each time after the continuous sheet having a thickness t has travelled a traveling distance L, the traveling distance L decreasing as the thickness t increases.

More specifically, as shown in FIG. 5A (see arrow R1), the shift mechanism 100 changes the distance between the rotation shafts of the second transfer roller 54 and the separating roller 55, serving as multiple rotary members to generate a meandering force in the thrust direction, which intersects the revolving direction, in the second transfer belt 53, which is stretched between and revolves around the second transfer roller 54 and the separating roller 55, thus moving the second transfer belt 53.

As shown in FIG. 5B, the shift mechanism 100 includes the second transfer roller 54, the separating roller 55, second transfer frames 101 and 101, separating-roller support frames 102R and 102L, an eccentric cam 103, a rotary actuator 104, and a tension spring 105.

The second transfer roller 54 is supported via bearings by the second transfer frames 101 and 101 so as to be rotatable, and the separating roller 55 is supported via bearings by the separating-roller support frames 102R and 102L so as to be rotatable.

The separating-roller support frame 102L is engaged with the second transfer frame 101 by means of a pin 106, and the separating-roller support frame 102R is supported by the second transfer frame 101 by means of a stud 107 so as to be movable within the range of the larger diameter of an elongated hole 108. The stud 107 projects through the elongated hole 108 in the second transfer frame 101 and is in contact with the eccentric cam 103. When rotated by the rotary actuator 104, the eccentric cam 103 moves the stud 107 within the range of the larger diameter of the elongated hole 108 in the second transfer frame 101, changing the distances D1 and D2 between the rotation shafts of the second transfer roller 54 and the separating roller 55. As a result, the second transfer belt 53 moves toward the side on which the distance between the rotation shafts is smaller.

For example, as shown in FIG. 6, when the rotary actuator 104 rotates the eccentric cam 103, the stud 107 moves in the direction of arrow R1 within the elongated hole 108, causing the rotation shaft of the separating roller 55 to move about the pin 106 and thus changing the distances D1 and D2 between the rotation shafts of the second transfer roller 54 and the separating roller 55 (D1>D2). As a result, the second transfer belt 53 moves toward the side (the D2 side) on which the distance between the rotation shafts is smaller.

In the system control unit 11, a traveling distance integrator 110 calculates the accumulated traveling distance L of the continuous sheet P fed from the sheet feed device 20 (S101). Then, from information about the thickness t, the movement timing T at which the shift mechanism 100 moves the second transfer belt 53 is calculated as: $T=20000\times 1/t$ (S102), and it is determined whether the accumulated traveling distance L has reached the movement timing T (S103). If it is determined that the accumulated traveling distance L has reached the movement timing T (S103: Yes), the system control unit 11 drivingly rotates the rotary actuator 104 by 180 degrees (S104) to move one end of the separating roller 55, moving the second transfer belt 53 in the thrust direction.

Then, the rotary actuator 104 is drivingly rotated again by 180 degrees (S105) to move the one end of the separating roller 55 back to the initial position, balancing the distances D1 and D2 between the rotation shafts of the second transfer roller 54 and the separating roller 55, thereby stopping the movement of the second transfer belt 53 in the thrust direction. Thereafter, the second transfer belt 53 is moved at each movement timing T until the total traveling distance L reaches the life of the second transfer belt 53 (S106: Yes).

By determining the movement timing T for moving the second transfer belt 53 in proportion to the inverse of the thickness t of the continuous sheet P, the second transfer belt 53 is moved in the thrust direction each time after the continuous sheet P has travelled a small traveling distance L, whereby it is possible to prevent the resin coat layers 53*a* from cracking at an early stage and thus to complete the predetermined life of the second transfer belt 53.

First Modification

In the exemplary embodiment above, the movement timing T at which the shift mechanism 100 moves the second transfer belt 53 is determined in proportion to the inverse of the thickness t. Alternatively, the movement timing T may be determined such that the traveling distance L, per which the second transfer belt 53 is moved, decreases as the pressing force N (see arrow N in FIG. 5A), with which the second transfer roller 54 presses a continuous sheet P with the second transfer belt 53 therebetween, increases.

In the second transfer part TR, a second-transfer electric field is generated to second-transfer a toner image while nipping, with a predetermined pressing force N, the continuous sheet P between the second transfer belt 53 and the backup roller 65, which opposes the second transfer belt 53 with the intermediate transfer belt 51 therebetween. The pressing force N is set to be larger as the thickness t of the continuous sheet P is larger. Hence, if the thickness t is large, the resin coat layers 53*a* of the second transfer belt 53 are repeatedly strained and unstrained while receiving a large pressing force as they pass through the transfer nip, which may lead to fatigue breakage and cracking.

Thus, in the image forming apparatus 1 according to the first modification, the movement timing T for moving the second transfer belt 53 is determined such that the traveling distance L, per which the second transfer belt 53 is moved, decreases as the pressing force N, with which the second transfer roller 54 presses the continuous sheet P with the second transfer belt 53 therebetween, increases.

Second Modification

Figure 8A:
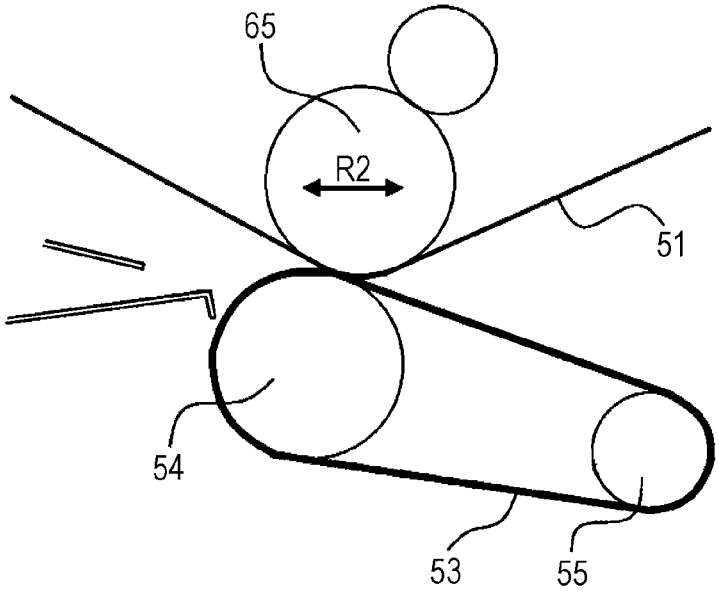
FIG. 8A is a schematic cross section of a second transfer part, showing that a shift mechanism according to a second modification moves a rotation shaft of a backup roller.
Figure 8B:
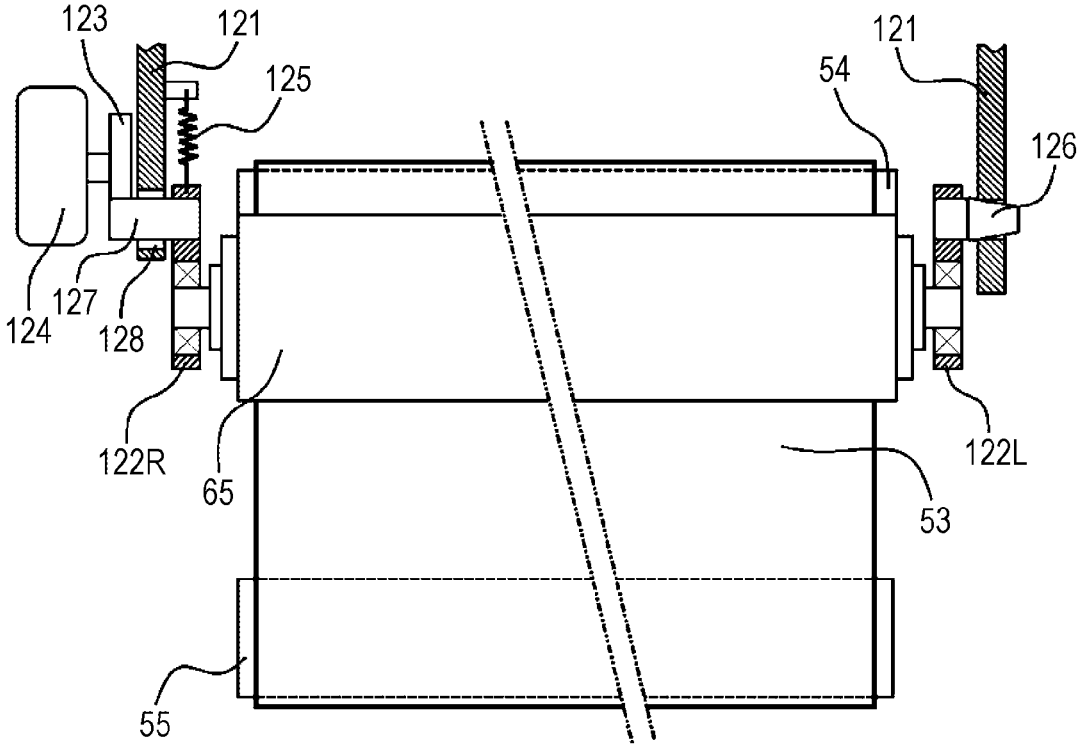
FIG. 8B is a schematic plan view showing a configuration example of the shift mechanism according to the second modification.
Figure 9:
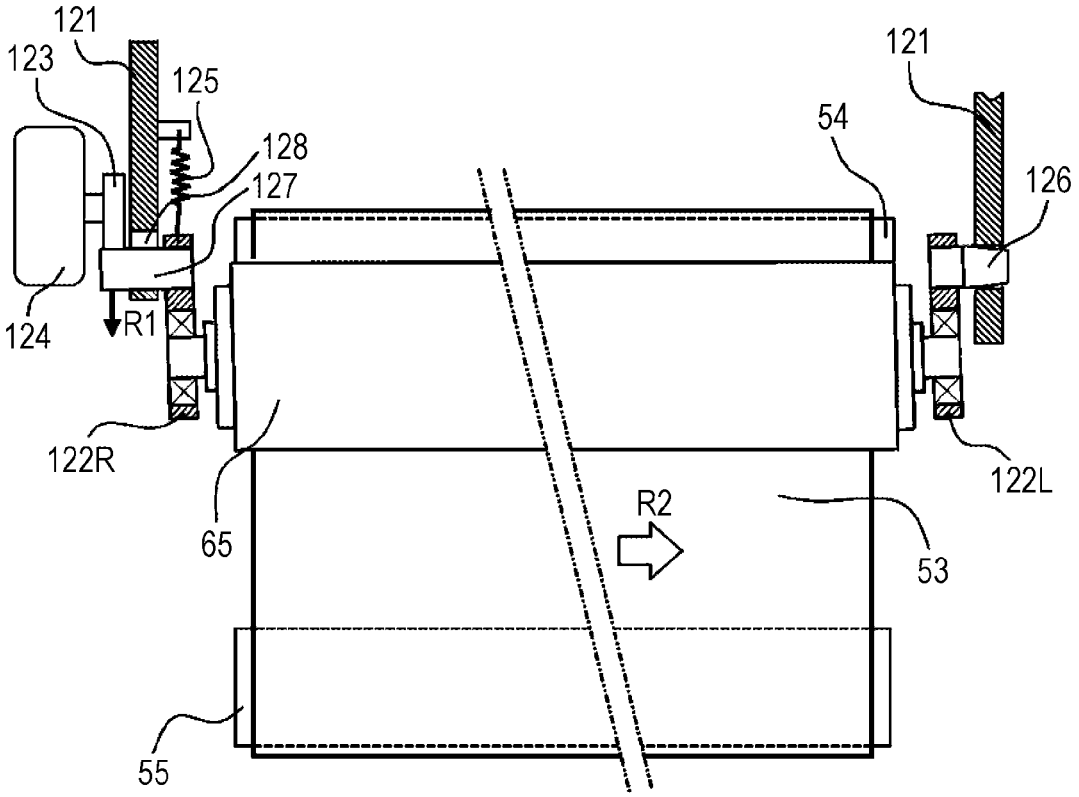
FIG. 9 is a schematic plan view showing that an operation of the shift mechanism according to the second modification moves the rotation shaft of the backup roller, moving the second transfer belt in the thrust direction.

FIG. 8A is a schematic cross section of the second transfer part TR, showing that a shift mechanism 100A according to a second modification moves the rotation shaft of the backup roller 65, and FIG. 8B is a schematic plan view showing a configuration example of the shift mechanism 100A. FIG. 9 is a schematic plan view showing that an operation of the shift mechanism 100A according to the second modification moves the rotation shaft of the backup roller 65, moving the second transfer belt 53 in the thrust direction.

A mechanism for moving the second transfer belt 53 in a direction intersecting the direction in which a continuous sheet is transported may be the shift mechanism 100A that moves the second transfer belt 53 by moving the rotation shaft of the backup roller 65 so as to intersect the rotation shaft of the second transfer roller 54, as shown in FIG. 8A (see arrow R2 in FIG. 8A).

As shown in FIG. 8B, the shift mechanism 100A includes the second transfer roller 54, the separating roller 55, the backup roller 65, transfer frames 121, backup-roller support frames 122R and 122L, an eccentric cam 123, a rotary actuator 124, and a tension spring 125. The backup roller 65 is supported via bearings by the backup-roller support frames 122R and 122L so as to be rotatable.

The backup-roller support frame 122L is engaged with the transfer frame 121 by means of a pin 126, and the backup-roller support frame 122R is supported by the transfer frame 121 by means of a stud 127 so as to be movable within the range of the larger diameter of an elongated hole 128. The stud 127 projects through the elongated hole 128 in the transfer frame 121 and is in contact with the eccentric cam 123.

When rotated by the rotary actuator 124, the eccentric cam 123 moves the stud 127 within the range of the larger diameter of the elongated hole 128 in the transfer frame 121, making the rotation shaft of the backup roller 65 intersect the rotation shaft of the second transfer roller 54. As a result, the second transfer belt 53 is subjected to a meandering force acting in the thrust direction, which intersects the revolving direction, and moves in the thrust direction.

For example, as shown in FIG. 9, when the rotary actuator 124 rotates the eccentric cam 123, the stud 127 moves in the direction of arrow R1 within the elongated hole 128, causing the rotation shaft of the backup roller 65 to move about the pin 126 and thus making the rotation shaft and the second transfer roller 54 intersect each other. As a result, the second transfer belt 53 revolving while being nipped between the second transfer roller 54 and the backup roller 65 moves in the direction of arrow R2 in FIG. 9.

In this shift mechanism 100A, when the accumulated traveling distance L of the continuous sheet P has reached the movement timing T (=20000×1/t) determined on the basis of the thickness t, the rotary actuator 124 is drivingly rotated by 180 degrees to move one end of the backup roller 65, moving the second transfer belt 53 in the thrust direction.

Then, the rotary actuator 124 is drivingly rotated again by 180 degrees to move the backup roller 65 back to the initial position, thereby stopping the movement of the second transfer belt 53 in the thrust direction. Thereafter, the second transfer belt 53 is moved at each movement timing T until the total traveling distance L reaches the life of the second transfer belt 53.

EXAMPLE

FIG. 10A is a table showing the distances L travelled by continuous sheets P before the resin coat layers 53*a* of the second transfer belt 53 crack in a comparison example, and FIG. 10B is a table showing the relationship between the traveling distance L and cracking in the resin coat layers 53*a* of the second transfer belt 53 in an example.

To confirm the effect of the image forming apparatus 1 according to the first exemplary embodiment, rolls of polyethylene terephthalate (PET) transparent films, serving as continuous sheets P, having a thickness t of 100 μm, 150 μm, and 200 μm and a width of 300 mm are evaluated for their traveling properties. The evaluation is performed in a low-temperature, low-humidity environment (10° C./15% RH), using a test machine similar to the image forming apparatus as shown in FIG. 1. In the evaluation, first, an image with image densities of the respective colors (Y, M, C, and K) of 5% is formed, and then the presence of cracks is detected by forming a belt-like full-width filled image (M100%, C100%) having a length of 200 mm in the process direction each time after the sheet has travelled 10000 m.

COMPARISON EXAMPLE

In the comparison example, there is no shift mechanism 100. Hence, the continuous sheets P are made to travel without moving the second transfer belt 53 in the thrust direction.

As a result, as shown in FIG. 10A, it is confirmed that as the thickness of the continuous sheet P increases, the distance L traveled by the sheet before the resin coat layers 53*a* of the second transfer belt 53 crack decreases.

When the target life of the second transfer belt 53 is set to 500000 m, none of the continuous sheets P having the above thicknesses reaches that distance.

EXAMPLE

In the example, the timing at which the shift mechanism 100 moves the second transfer belt 53 in the thrust direction is set to: T=20000×1/t(m), and at each timing, the second transfer belt 53 is shifted by 1 mm in the thrust direction.

As a result, as shown in FIG. 8B, it is confirmed that, with all the continuous sheets P having the above thicknesses, no crack is generated until the target life, 500000 m, is reached.

Second Exemplary Embodiment

Figure 11:
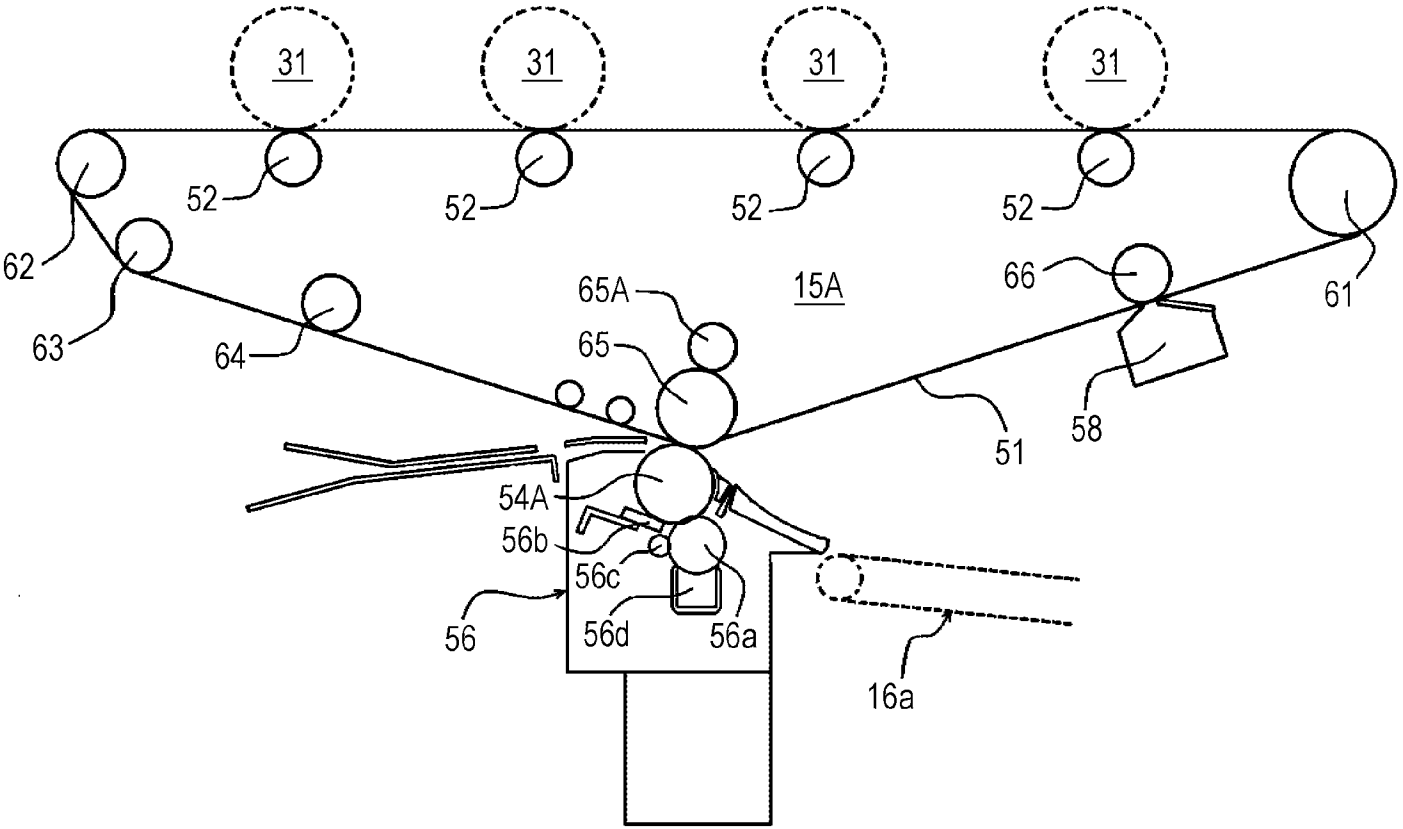
FIG. 11 is a schematic cross section showing the configuration of a transfer device of an image forming apparatus according to a second exemplary embodiment.
Figure 12A:
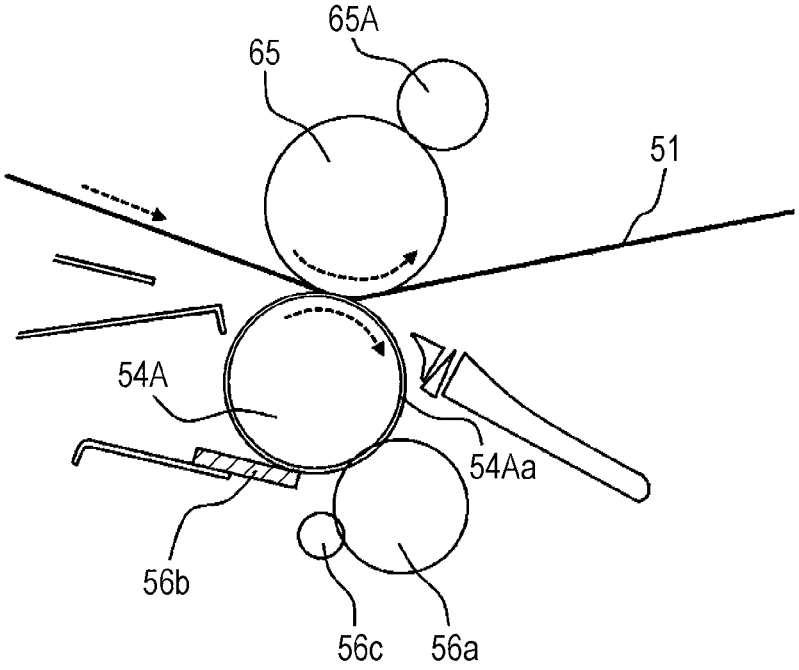
FIG. 12A is a schematic cross section showing the configuration of a second transfer part of the image forming apparatus according to the second exemplary embodiment.
Figure 12B:
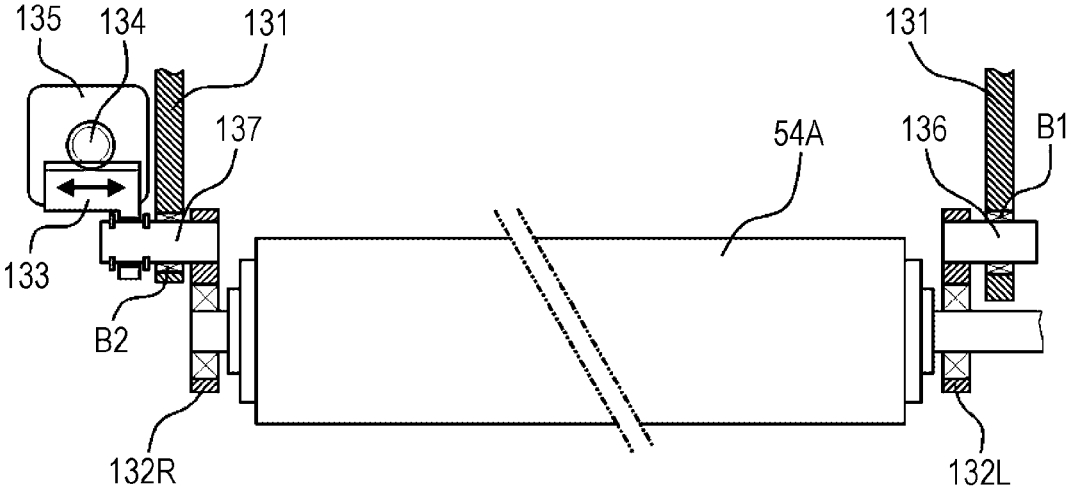
FIG. 12B is a schematic plan view showing a configuration example of a shift mechanism.

FIG. 11 is a schematic cross section showing the configuration of a transfer device 15A of an image forming apparatus 1A according to this exemplary embodiment, FIG. 12A is a schematic cross section showing the configuration of a second transfer part TR of the image forming apparatus 1A, and FIG. 12B is a schematic plan view showing a configuration example of a shift mechanism 100B.

Referring to the drawings, the image forming apparatus 1A will be described. The components that are the same as those of the image forming apparatus 1 according to the first exemplary embodiment will be denoted by the same reference signs, and detailed descriptions thereof will be omitted.

The transfer device 15A includes the intermediate transfer belt 51, the first transfer rollers 52, a second transfer unit 150 including a second transfer roller 54A, and the shift mechanism 100B.

The second transfer roller 54A, serving as the transfer member, is formed of a semiconducting rubber having a urethane-rubber-tube surface layer having a fluorocarbon coating, serving as a resin coat layer 54Aa, and having a volume resistivity of $10^6$ to $10^{10}$ Ω·cm. The second transfer roller 54A is formed to have a diameter of 28 mm, and the Asker C hardness is set to, for example, 30 degrees.

The second transfer roller 54A is disposed so as to oppose the backup roller 65 with the intermediate transfer belt 51 therebetween and forms, together with the backup roller 65, the second transfer part TR at which a toner image held on the intermediate transfer belt 51 is second-transferred to a continuous sheet P fed from the sheet feed device 20.

The cleaning device 56 is provided so as to oppose the second transfer roller 54A to remove residual toner, paper dust, etc., attached to the surface of the resin coat layer 54Aa.

The cleaning device 56 includes an application brush 56*a* for applying lubricant 56*d* to the surface of the second transfer roller 54 and a cleaning blade 56*b* for removing the residual toner, paper dust, etc., that were stirred up in advance by the application brush 56*a*.

A flicking bar 56*c* disposed in contact with the application brush 56*a* removes the residual toner, paper dust, etc., attached to the surface of the application brush 56*a* and levels the lubricant 56*d* on the application brush 56*a*.

As shown in FIG. 12B, the shift mechanism 100B includes the second transfer roller 54A, transfer frames 131, second-transfer-roller support frames 132R and 132L, a rack gear 133, a pinion gear 134, and a rotary actuator 135. The second transfer roller 54A is supported via bearings by the second-transfer-roller support frames 132R and 132L so as to be rotatable.

The second-transfer-roller support frame 132L is supported, via a bushing B1, by the transfer frame 131 by means of a stud 136 so as to be movable in the sliding direction, and the second-transfer-roller support frame 132R is supported, via a bushing B2, by the transfer frame 131 by means of a stud 137 so as to be movable in the sliding direction. The rack gear 133 is attached between fasteners C on the stud 137, and the rack gear 133 is in mesh with the pinion gear 134.

The pinion gear 134 rotated by the rotary actuator 135 slides the rack gear 133 (see the arrow in FIG. 10B), moving the stud 137, to which the rack gear 133 is attached, and the second-transfer-roller support frames 132R and 132L in the thrust direction. As a result, the second transfer roller 54A moves in the thrust direction, which intersects the sheet transport direction.

In this shift mechanism 100B, when the accumulated traveling distance L of the continuous sheet P has reached the movement timing T (=20000×1/t) determined by the thickness t, the rotary actuator 135 is drivingly rotated to move the second transfer roller 54A in the thrust direction.

The movement timing T at which the shift mechanism 100B moves the second transfer roller 54A in the thrust direction may be determined such that the traveling distance L, per which the second transfer belt 53 is moved, decreases as the pressing force N with which the second transfer roller 54A presses the continuous sheet P increases.

This way, by moving the second transfer roller 54A in the thrust direction with the shift mechanism 100B such that the traveling distance L decreases as the thickness t increases, the resin coat layer 54Aa can be prevented from cracking.

Furthermore, by moving the second transfer roller 54A in the thrust direction with the shift mechanism 100B such that the traveling distance L decreases as the pressing force N with which the second transfer roller 54A presses the continuous sheet P increases, the resin coat layer 54Aa can be prevented from cracking.

Although the exemplary embodiment of the present invention has been described in detail above, the present invention is not limited to the above-described exemplary embodiment, and it may be variously modified within the scope of the claims of the present invention.

For example, in this exemplary embodiment, the image forming apparatus 1 has been described as an intermediate-transfer-type tandem color printer, which uses an intermediate transfer belt. However, the present invention can also be applied to a direct-transfer-type image forming apparatus, which has a sheet transport belt.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer member that transfers a toner image to a sheet, the transfer member having a lower hardness than a member opposed thereto with the sheet therebetween when the sheet is transported; and a moving unit that moves the transfer member in a width direction extending along a surface of the sheet and intersecting the direction in which the sheet is transported.

2. The image forming apparatus according to claim 1, wherein the moving unit moves the transfer member each time after the sheet having a thickness has travelled a distance, the distance decreasing as the thickness increases.

3. The image forming apparatus according to claim 2, wherein the transfer member is a belt-shaped transfer member wound around multiple rotary members, and the moving unit moves the transfer member by changing the distance between a rotation shaft of the plurality of rotary members in the direction in which the plurality of rotary members rotate.

4. The image forming apparatus according to claim 2, further comprising an opposing member that opposes the transfer member with an image carrier carrying a toner image therebetween, wherein the moving unit moves the transfer member by moving one end of a rotation shaft of the opposing member.

5. The image forming apparatus according to claim 2, wherein the transfer member is a roller-shaped transfer member including a rotation shaft, an elastic layer formed around the rotation shaft, and a surface layer covering the surface of the elastic layer, and the moving unit moves the transfer member by moving one end of the rotation shaft.

6. The image forming apparatus according to claim 5, wherein the moving unit moves the transfer member each time after the sheet has travelled a distance, the distance decreasing as a thickness of the surface layer decreases.

7. The image forming apparatus according to claim 5, wherein the moving unit moves the transfer member each time after the sheet has travelled a distance, the distance decreasing as a hardness of the elastic layer increases.

8. The image forming apparatus according to claim 1, wherein the moving unit moves the transfer member each time after the sheet has travelled a distance, the distance decreasing as a pressing force with which the transfer member presses the sheet increases.

9. The image forming apparatus according to claim 8, wherein the transfer member is a belt-shaped transfer member wound around multiple rotary members, and the moving unit moves the transfer member by changing the distance between a rotation shaft of the plurality of rotary members in the direction in which the plurality of rotary members rotate.

10. The image forming apparatus according to claim 8, further comprising an opposing member that opposes the transfer member with an image carrier carrying the toner image therebetween, wherein the moving unit moves the transfer member by moving one end of a rotation shaft of the opposing member.

11. The image forming apparatus according to claim 8, wherein the transfer member is a roller-shaped transfer member including a rotation shaft, an elastic layer formed around the rotation shaft, and a surface layer covering the surface of the elastic layer, and the moving unit moves the transfer member by moving one end of the rotation shaft.

12. The image forming apparatus according to claim 11, wherein the moving unit moves the transfer member each time after the sheet has travelled a distance, the distance decreasing as a thickness of the surface layer decreases.

13. The image forming apparatus according to claim 11, wherein the moving unit moves the transfer member each time after the sheet has travelled a distance, the distance decreasing as a hardness of the elastic layer increases.

14. The image forming apparatus according to claim 1, wherein the transfer member is a belt-shaped transfer member wound around multiple rotary members, and the moving unit moves the transfer member by changing the distance between a rotation shaft of the plurality of rotary members in the direction in which the plurality of rotary members rotate.

15. The image forming apparatus according to claim 1, further comprising an opposing member that opposes the transfer member with an image carrier carrying the toner image therebetween, wherein the moving unit moves the transfer member by moving one end of a rotation shaft of the opposing member.

16. The image forming apparatus according to claim 1, wherein the transfer member is a roller-shaped transfer member including a rotation shaft, an elastic layer formed around the rotation shaft, and a surface layer covering the surface of the elastic layer, and the moving unit moves the transfer member by moving one end of the rotation shaft.

17. The image forming apparatus according to claim 16, wherein the moving unit moves the transfer member each time after the sheet has travelled a distance, the distance decreasing as a thickness of the surface layer decreases.

18. The image forming apparatus according to claim 16, wherein the moving unit moves the transfer member each time after the sheet has travelled a distance, the distance decreasing as a hardness of the elastic layer increases.

19. An image forming apparatus comprising:

a transfer member for transferring a toner image to a sheet, the transfer member having a lower hardness than a member opposed thereto with the sheet therebetween when the sheet is transported; and moving means for moving the transfer member in a width direction extending along a surface of the sheet intersecting the direction in which the sheet is transported.

* * * * *